US009656681B2

(12) United States Patent
Eckl, Jr. et al.

(10) Patent No.: US 9,656,681 B2
(45) Date of Patent: May 23, 2017

(54) CIRCUIT ARRANGEMENT FOR REVEALING LIGHT SIGNAL ERRORS

(71) Applicant: SIEMENS AKTIENGESELLSCHAFT, Munich (DE)

(72) Inventors: Rolf Eckl, Jr., Berlin (DE); Kay Koester, Fredersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 91 days.

(21) Appl. No.: 14/648,751

(22) PCT Filed: Nov. 14, 2013

(86) PCT No.: PCT/EP2013/073792
§ 371 (c)(1),
(2) Date: Jun. 1, 2015

(87) PCT Pub. No.: WO2014/082860
PCT Pub. Date: Jun. 5, 2014

(65) Prior Publication Data

US 2015/0298713 A1 Oct. 22, 2015

(30) Foreign Application Priority Data

Nov. 30, 2012 (DE) ..... 10 2012 221 972

(51) Int. Cl.
*B61L 29/00* (2006.01)
*B61L 29/24* (2006.01)
(Continued)

(52) U.S. Cl.
CPC ..... *B61L 29/243* (2013.01); *B61L 5/1881* (2013.01); *B61L 1/20* (2013.01); *B61L 2207/02* (2013.01)

(58) Field of Classification Search
CPC .... B61L 29/243; B61L 15/1881; B61L 11/20; B61L 2207/02
See application file for complete search history.

(56) References Cited

U.S. PATENT DOCUMENTS 7,750,663 B2 * 7/2010 Cop ..... G01R 31/343 324/765.01
2010/0258682 A1 * 10/2010 Fries ..... B61L 3/121 246/1 C (Continued)

FOREIGN PATENT DOCUMENTS

CN 1788209 A 6/2006
DE 270044 A1 7/1989

(Continued)

*Primary Examiner* — Jason C Smith
(74) *Attorney, Agent, or Firm* — Laurence Greenberg; Werner Stemer; Ralph Locher

(57) ABSTRACT

A circuit arrangement for revealing light signal errors, in particular for railway safety systems, includes an electronic signal generator, which can be disconnected in a reversible manner in the event of an error, and a control part, configured for incandescent lamps, for controlling and monitoring the signal generator. The device for revealing errors includes an error differentiator between the line-related interference voltage and error of the signal generator. The reliability of the error differentiation is improved and rendered independent of capacitive intermediate energy storage devices, in that the signal generator is connected to a resistance arrangement such that the signal generator voltage is greater, in high-resistance signal generators, than an interference voltage.

4 Claims, 2 Drawing Sheets

(51) Int. Cl.
*B61L 5/18* (2006.01)
*B61L 1/20* (2006.01)

(56) References Cited

U.S. PATENT DOCUMENTS

| | | | | |
|---|---|---|---|---|
| 2011/0276285 | A1* | 11/2011 | Alexander | B61L 5/1881 702/58 |
| 2012/0293074 | A1* | 11/2012 | Fries | B61L 5/189 315/130 |
| 2012/0325981 | A1* | 12/2012 | Lostun | B61L 27/0061 246/219 |
| 2013/0099933 | A1* | 4/2013 | Berg | B61L 5/1827 340/815.45 |
| 2013/0141133 | A1* | 6/2013 | Kratochvil | H01L 31/02021 324/761.01 |
| 2014/0166822 | A1* | 6/2014 | Berg | B61L 23/00 246/473 R |
| 2015/0298713 | A1* | 10/2015 | Eckl, Jr. | B61L 29/243 246/473 R |

FOREIGN PATENT DOCUMENTS

| | | | |
|---|---|---|---|
| DE | 102008027632 | A1 | 12/2009 |
| DE | 102010036514 | A1 | 1/2012 |
| EP | 2131628 | A2 | 12/2009 |
| EP | 2463174 | A1 | 6/2012 |
| SU | 779141 | A1 | 11/1980 |
| WO | 03096753 | A1 | 11/2003 |

* cited by examiner

CIRCUIT ARRANGEMENT FOR REVEALING LIGHT SIGNAL ERRORS

BACKGROUND OF THE INVENTION

Field of the Invention

The invention relates to a circuit arrangement for revealing errors in the case of a light signal, particularly for railway safety installations, having an electronic signal transmitter, which disconnects itself reversibly in the event of an error, and an actuating part, designed for incandescent lamps, for actuating and monitoring the signal transmitter, wherein the revelation of errors comprises error differentiation between line-conditioned influencing voltage and errors in the signal transmitter.

The description below relates essentially to light signals for railway safety installations, without the invention being limited to this application. Rather, application is also conceivable from other traffic systems or in the industrial sector, for example.

In the case of incandescent lamp light signals, the lines are dimensioned such that influencing the signal wires prompts the influencing current to flow through the incandescent lamp and this influencing current does not result in the incandescent lamp lighting. Actuating parts that are designed for incandescent lamp light signals usually evaluate a signal current in order to establish an error or correct operation of the light signal.

When incandescent lamp signal transmitters are replaced by electronic signal transmitters, for example for LED light sources, the influencing current results in the electronics working but the low energy for the influencing meaning that it is not possible to start the signal transmitter. The signal voltage falls upon a starting attempt and the signal transmitter that disconnects itself reversibly begins the next starting attempt.

This starting procedure is also effective when there is a low-impedance error in the signal transmitter. The impedance of the signal line causes the signal voltage to collapse when the electronics are engaged. In this case, a very large current flows that the actuating part rates not as an error but rather as a valid signal current. By contrast, the electronics cannot measure the current on account of the low voltage and possibly begin a new starting attempt.

The same starting behavior for an error-free signal transmitter with influencing and a signal transmitter with a low-impedance error means that the cause of error cannot be identified. Therefore, it is necessary to ensure that the electronic signal transmitter can distinguish between signal transmitter voltage and influencing voltage in order to reveal not only the presence of an error but also the cause of error.

To date, this problem has been solved in that the actuating part identifies the error in the event of an excessively large flow of current and in that the signal transmitter identifies the error, and transmits it to the actuating part, in the event of only a slightly increased flow of current. This error revelation is not always assured in the event of relatively high impedances on the signal line, however, since there is a gap between the identification of current flow by the actuating part and the identification of current flow by the signal transmitter. This gap in the identification of current flow is closed by virtue of the signal transmitter evaluating the current immediately after the start, that is to say before the signal voltage collapses. This requires signal-transmitter-internal capacitors that are charged by the actuating part and supply the signal transmitter with current for a sufficiently long time. After the electronics of the signal transmitter with a low-impedance error have started, large currents can therefore be measured and used for error identification. A prerequisite is that the capacitors can store their energy for a sufficiently long time. The operation of the capacitors is usually not tested, however.

BRIEF SUMMARY OF THE INVENTION

Accordingly, the invention is based on the object of increasing the reliability of error differentiation between line-conditioned influencing voltage and low-impedance error in the signal transmitter. In this case, there is a particular desire for independence for capacitive energy buffers.

The invention achieves the object in that the signal transmitter has a connected resistor arrangement such that a high-impedance signal transmitter prompts the signal transmitter voltage to be higher than the influencing voltage. The resistor arrangement means that the signal transmitter voltage and the influencing voltage are more or less separated and thereby distinguishable from one another. The resistor arrangement consists of loads that lower the influencing voltage. In the event of an error, the voltage immediately collapses following the start of a signal transmitter. The signal transmitter therefore becomes high-impedance. Subsequently, the voltage rises again, with the resistor arrangement meaning that the signal transmitter voltage of the high-impedance signal transmitter is higher than the influencing voltage. In the case of error-free signal transmitter and influencing voltage, the influencing voltage is measured following the switch to high impedance, whereas the signal transmitter voltage is measured in the event of a faulty signal transmitter.

It is particularly advantageous that the starting currents do not need to be evaluated and the capacitors that are required therefor as an energy source do not need to be precisely dimensioned and frequently checked. Only the dimensioning of the resistor arrangement needs to be stipulated such that the signal transmitter becomes high-impedance only such that the influencing voltage remains lower than the voltage on the signal transmitter.

Given an identified signal transmitter voltage and repeated failed starting attempts, an error message is sent to the actuating part by virtue of the signal transmitter switching to high impedance, which infers a signal transmitter error, that is to say an error in the assembly or a faulty high-impedance clamping point in the signal cable area, on account of the excessively small signal current.

Given influencing voltage, the threshold for identifying the signal transmitter voltage is not reached, which means that a new starting attempt does not take place and an error message is not sent either.

According to the invention, a voltage threshold value is applied for error differentiation between the signal transmitter voltage and the influencing voltage, with a rise above said voltage threshold value involving the presence of an error in the signal transmitter and a drop below said voltage threshold value involving the presence of influencing. Preferably, the voltage threshold value is positioned approximately in the center between the signal transmitter voltage and the influencing voltage in order to achieve the safest possible error association.

In an advantageous development according to the invention, the resistor arrangement is in disconnectable form, this disconnection being effected, according to the invention, particularly when errors are revealed. This makes correct error transmission to the actuating part independent of any repercussions from the resistor arrangement and, as in the case of the known error revelation described above, is effected as a result of the signal transmitter switching to high impedance and hence the signal current being lowered.

BRIEF DESCRIPTION OF THE SEVERAL VIEWS OF THE DRAWING

The invention is explained in more detail below with reference to illustrations in the figures, in which.

DESCRIPTION OF THE INVENTION

Figure 1:
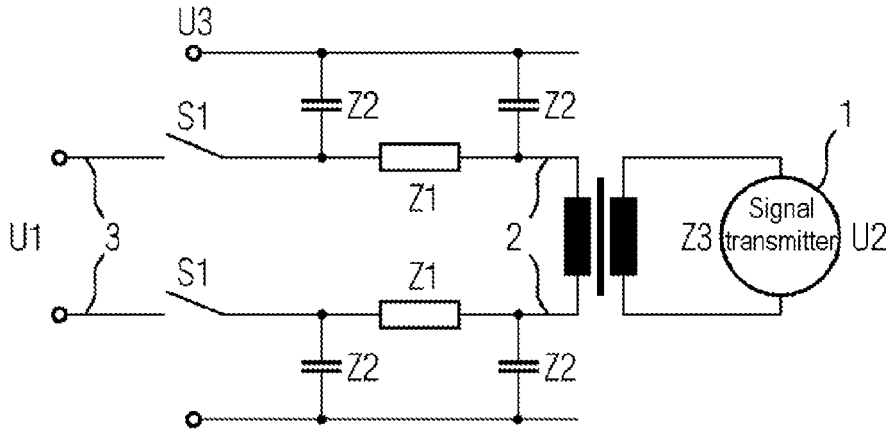
FIG. 1 shows the basic principle of a signal circuit.

FIG. 1 illustrates the connection of a signal transmitter 1 via a signal line 2, which is connected via a switch S1 to a signal voltage U1 that is provided by an actuating part, which is usually a long way away from the signal transmitter 1, but that has a voltage source 3. In this case, U2 is the signal transmitter voltage and U3 is a line-conditioned influencing voltage. The signal transmitter 1 has the signal transmitter voltage U2 and the impedance Z3 associated with it. The signal voltage U1 is connected to the signal transmitter 1 by the actuating part via S1 and the signal line 2 with the impedance Z1. The influencing voltage U3 is permanently applied to the signal transmitter 1 via Z2.

Figure 2:
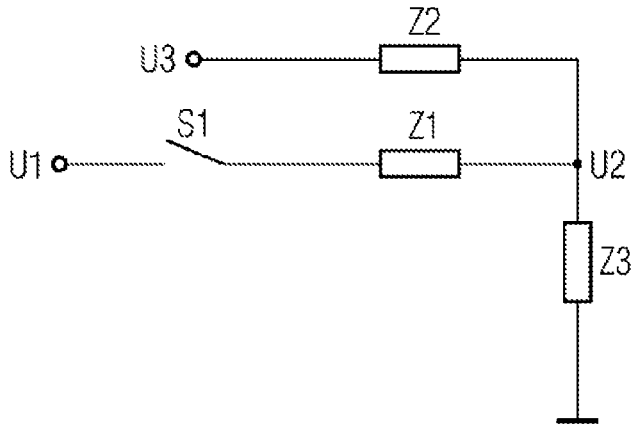
FIG. 2 shows a simplified illustration of the basic principle shown in FIG. 1.

An appropriately simplified circuit illustration is shown in FIG. 2. The impedance Z1 of the signal voltage U1 is much lower than the impedance Z2 of the influencing voltage U3. Hence, $$U2 = U1\frac{Z3}{Z1 + Z3}$$

for the signal transmitter voltage and $$U2 = U3\frac{Z3}{Z2 + Z3}$$

for the influencing voltage.

U2 for the signal transmitter voltage is much higher than U2 for the influencing voltage.

Figure 3:
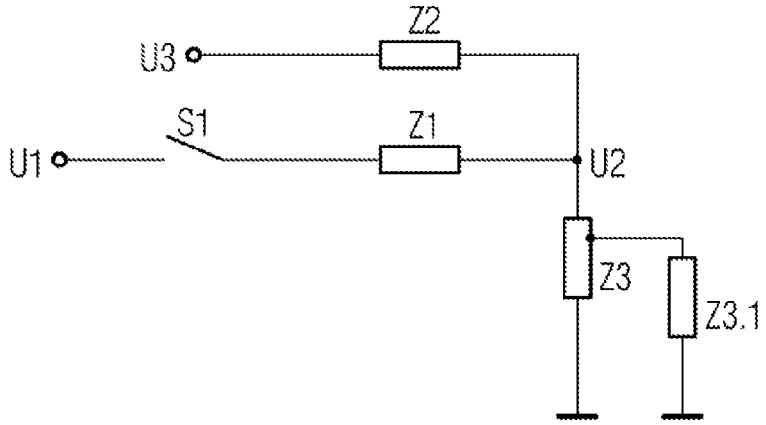
FIG. 3 shows a signal circuit with an erroneous signal transmitter in the manner of illustration shown in FIG. 2.

FIG. 3 additionally shows a signal transmitter error as Z3.1. This supplementary impedance Z3.1 of the signal transmitter 1 means that U2 for the signal transmitter voltage falls to the value of U2 for the influencing voltage. Hence, $$U2 = U1\frac{Z3 + Z3.1}{Z1 + Z3 + Z3.1} \approx U3\frac{Z3}{Z2 + Z3}$$

Consequently, when measuring the voltage U2 across the signal transmitter 1 that is not switched to high impedance, it is not possible to distinguish between influencing voltage and signal transmitter voltage.

In order to produce distinguishability, the signal transmitter 1 has, according to the invention, a connected resistor arrangement that reduces the influencing voltage.

Figure 4:
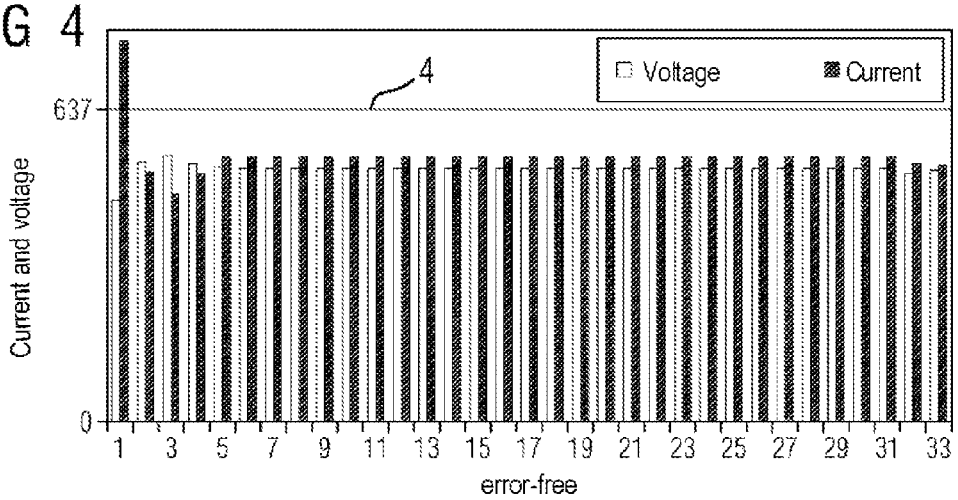
FIG. 4 shows a graph for the switch-on behavior of an error-free signal transmitter.
Figure 5:
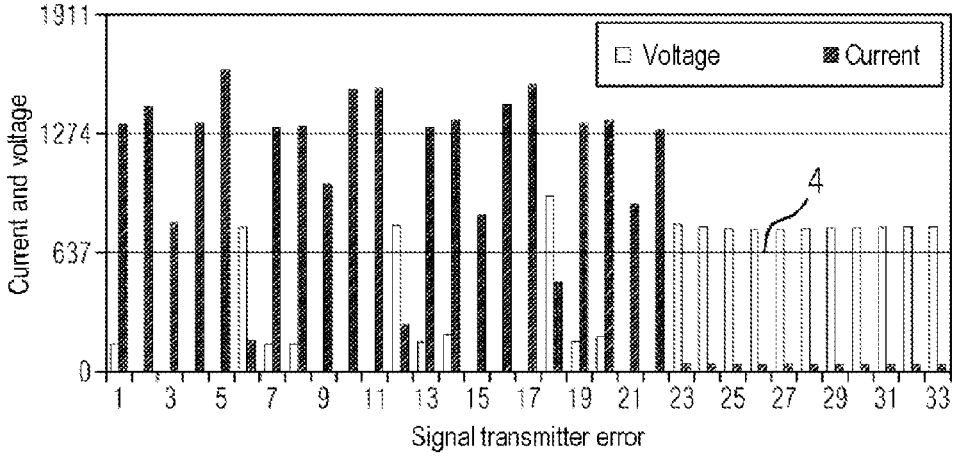
FIG. 5 shows a graph for the switch-on behavior with an erroneous signal transmitter.
Figure 6:
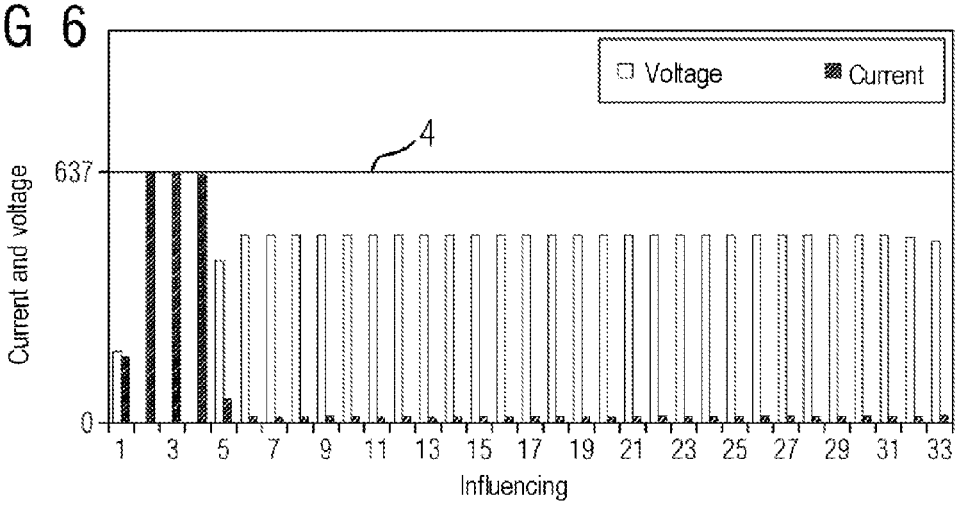
FIG. 6 shows a graph of the switch-on behavior in the event of influencing.

The graphs in FIGS. 4 to 6 each show 33 successfully measured current/voltage value pairs. Current and voltage are not normalized. The measured value 637 in the three graphs denotes a voltage threshold value 4 for distinguishing between influencing voltage and signal transmitter voltage in the high-impedance state of the signal transmitter.

In FIG. 4, the signal transmitter 1 operates in error-free fashion at low voltage, as a result of which, in stable continuous operation, the signal transmitter 1 has a voltage drop across it that results from Z1 and Z3. Since the signal transmitter 1 is not at high impedance, there is a larger voltage drop across Z1 than in the high-impedance state of Z3. For this reason, the measured voltage is lower than the threshold value 4. Signal transmitter voltage and influencing voltage are distinguished only when the signal transmitter is at high impedance.

FIGS. 5 and 6 show different error states, wherein the current/voltage value pairs with voltage value 0 indicate a collapsed signal transmitter voltage, which means that the current values of these value pairs are also invalid.

FIG. 5 shows a typical measured value characteristic for a low-impedance error Z3.1 in the signal transmitter 1 and a connected signal voltage U1. It can be seen that the voltage of the value pairs 1, 7, 8, 13, 14, 19 and 20 is very low, whereas the current is very high. The high current values in connection with the high voltage values of the value pairs 6, 12 and 18 exceed the threshold value 4, since the signal transmitter 1 has switched to the high-impedance state for these value pairs 6, 12 and 18. The high-impedance state for the cited value pairs 6, 12 and 18 and for the rise above the threshold value 4 restarts the signal transmitter 1. Following repeated "false starts" for the value pairs 1, 7 and 19, the signal transmitter 1 switches to high impedance for the value pairs greater than 22 and thus reports its error to the actuating part. In this case, the signal transmitter voltage is higher than the threshold value 4.

FIG. 6 shows the switch-on behavior at influencing voltage (U3). In the case of influencing, the signal transmitter 1 first of all starts and then switches to the high-impedance state. From the fifth value pair onwards, the signal transmitter 1 is at high impedance and the voltage remains below the threshold value 4, as a result of which the influencing voltage is identified. The switch S1 of the actuating part is open in this state.

When the switch S1 of the actuating part closes, the voltage rises above the threshold value 4 and the signal transmitter 1 starts as in FIG. 4.

The invention claimed is:

1. A circuit arrangement for revealing errors in a signaling light, the circuit arrangement comprising:

an electronic signal transmitter configured to disconnect itself reversibly in the event of an error; and an actuating part, configured for incandescent lamps, for actuating and monitoring said signal transmitter;

a resistor configuration connected to said signal transmitter to enable a revelation of errors to differentiate between line-conditioned influencing voltage and errors in the signal transmitter in that a high-impedance signal transmitter prompts a signal transmitter voltage to be higher than the line-conditioned influencing voltage; and wherein a voltage threshold value is provided for error differentiation between the signal transmitter voltage and the influencing voltage, and wherein a rise above the voltage threshold value indicates an error in the signal transmitter and a drop below the voltage threshold value indicates a presence of an influencing voltage.

2. The circuit arrangement according to claim 1, wherein the signaling light is a light signal for a railway safety installation.

3. The circuit arrangement as claimed in claim 1, wherein said resistor configuration is a disconnectable resistor configuration.

4. The circuit arrangement as claimed in claim 3, wherein said resistor configuration is disconnected when errors are revealed.

* * * * *